US009447597B2

(12) United States Patent
Hejazi et al.

(10) Patent No.: US 9,447,597 B2
(45) Date of Patent: Sep. 20, 2016

(54) VARIABLE STIFFNESS BRACING DEVICE

(71) Applicant: UNIVERSITI PUTRA MALAYSIA, Serdang, Selangor (MY)

(72) Inventors: Farzad Hejazi, Serdang (MY); Mohd Saleh Jaafar, Serdang (MY); Amir Fateh, Serdang (MY)

(73) Assignee: UNIVERSITI PUTRA MALAYSIA, Selangor (MY)

( * ) Notice: Subject to any disclaimer, the term of this patent is extended or adjusted under 35 U.S.C. 154(b) by 0 days.

(21) Appl. No.: 14/741,421

(22) Filed: Jun. 16, 2015

(65) Prior Publication Data

US 2015/0361657 A1 Dec. 17, 2015

(30) Foreign Application Priority Data

Jun. 16, 2014 (MY) ..... P12014701608

(51) Int. Cl.
*E04B 1/98* (2006.01)
*E04H 12/20* (2006.01)
*E04H 9/02* (2006.01)

(52) U.S. Cl.
CPC ..... *E04H 9/027* (2013.01); *E04H 9/021* (2013.01); *E04B 1/98* (2013.01); *E04H 9/02* (2013.01); *E04H 9/023* (2013.01)

(58) Field of Classification Search
CPC .. E04B 1/985; E04B 2001/2496; E04B 1/98; E04B 1/24; E04B 2001/2415; E04B 1/58; E04H 9/027; E04H 9/023; E04H 9/021; E04H 9/02; E02D 27/34; E02D 31/08
USPC ..... 52/146–152, 167.1–167.9
See application file for complete search history.

(56) References Cited

U.S. PATENT DOCUMENTS 2,359,036 A * 9/1944 Harper ..... B60G 99/002 105/187
2,799,778 A * 7/1957 Stephenson ..... H01P 7/04 206/583
4,633,628 A * 1/1987 Mostaghel ..... E02D 27/34 52/167.7
5,102,107 A * 4/1992 Simon ..... F16F 1/366 248/621
5,215,382 A * 6/1993 Kemeny ..... E04H 9/022 14/73.5
5,452,548 A * 9/1995 Kwon ..... E01D 19/041 248/567

(Continued)

OTHER PUBLICATIONS

Spencer Jr, B.F. & Nagarajaiah, S., State of the art of structural control, *Journal of Structural Engineering*, 129(7), pp. 845-856 (2003).

(Continued)

*Primary Examiner* — Phi A
*Assistant Examiner* — Omar Hijaz
(74) *Attorney, Agent, or Firm* — Steven M. War, Esq.

(57) ABSTRACT

The present invention relates to a variable stiffness bracing device comprising: a rectangular frame (100) having a solid quarter cylinder (101) at each angle of the rectangular frame (100); a pair of leaf spring (200) attached at each end of the rectangular frame (100) at the solid quarter cylinder (101); a steel rail (300) fixed on top middle of the rectangular frame (100); a core (400) fixed at the tip of each leaf spring (200), the core (400) is slidable along the steel rail (300); a cubic core (500) located in the middle of the core (400); and a rod cable (600) passes through each end of the rectangular frame (100) and the core (400) and ended at the cubic core (500) located in the middle of the core (400). The above provision is advantageous as the present invention deploys wholly mechanical in retrofitting and rehabilitation of structures.

5 Claims, 3 Drawing Sheets

(56) References Cited

U.S. PATENT DOCUMENTS

| | | | | |
|---|---|---|---|---|
| 6,052,955 | A * | 4/2000 | Haider | A47C 3/0255 248/560 |
| 6,141,919 | A * | 11/2000 | Robinson | F16F 1/40 248/562 |
| 6,371,434 | B1 * | 4/2002 | Becker | G11B 33/08 248/610 |
| 6,923,299 | B2 | 8/2005 | Barbison et al. | 188/267.1 |
| 6,971,795 | B2 * | 12/2005 | Lee | E04H 9/023 14/73.5 |
| 7,325,792 | B2 * | 2/2008 | Siino | F16F 1/065 267/33 |
| 7,337,586 | B2 * | 3/2008 | Lin | E01D 19/00 52/167.1 |
| 8,307,586 | B2 * | 11/2012 | Tsai | E04H 9/023 248/562 |
| 8,973,312 | B2 * | 3/2015 | Tsai | E04B 1/98 248/636 |
| 9,175,468 | B1 * | 11/2015 | Tsai | E04B 1/985 |
| 9,255,399 | B2 * | 2/2016 | Ruan | E02D 27/42 |
| 9,322,171 | B2 * | 4/2016 | Tsai | E04C 3/06 |
| 2004/0107654 | A1 * | 6/2004 | Powell | E04H 9/02 52/167.3 |
| 2005/0138870 | A1 * | 6/2005 | Ishimura | E01D 19/00 52/167.1 |
| 2008/0098671 | A1 * | 5/2008 | Tsai | E04H 9/023 52/167.6 |
| 2010/0313496 | A1 * | 12/2010 | Rahimian | E04H 9/02 52/167.3 |
| 2012/0038091 | A1 * | 2/2012 | Tagawa | E04H 9/021 267/136 |
| 2013/0174501 | A1 * | 7/2013 | Michael | F16F 9/303 52/167.1 |
| 2014/0360108 | A1 * | 12/2014 | Fujiu | F16F 15/04 52/167.7 |

OTHER PUBLICATIONS

Soong, T.T. & Dargush, G.F., Passive energy dissipation systems in structural engineering (1997).

Symans, M.D. et al., Energy dissipation systems for seismic applications: current practice and recent developments, *Journal of Structural Engineering*, 134(1), pp. 3-21 (2008).

Yao, J.T.P., Concept of structural control, *Journal of the Structural Division*, 98(7), pp. 1567-1574 (1972).

Karnopp, D., Crosby, M.J. & Harwood, R.A., Vibration control using semi-active force generators, *Journal of Manufacturing Science and Engineering*, 96(2), pp. 619-626 (1974).

Bruneau M, Uang CM, Whittaker A., Ductile design of steel structures, NewYork(USA): McGraw-Hill; 1998.

Kobori, T. et al., Seismic response controlled structure with active variable stiffness system, *Earthquake Engineering & Structural Dynamics*, 22(11), pp. 925-941 (1993).

Yang, J.N., Wu, J.C. & Li, Z., Control of seismic-excited buildings using active variable stiffness systems, *Engineering Structures*, 18(8), pp. 589-596 (1996).

Kobori, T. & Kamagata, S., Dynamic intelligent buildings: Active seismic response control, Intelligent Structures, 2, pp. 274-279 (1992).

Kamagata, S. & Kobori, T., Autonomous adaptive control of active variable stiffness system for seismic ground motion, *Proc., First World Com on Struct. Control, TA4*, pp. 33-42 (1994).

Development and Experimental Study of Semi-Active Fluid Damping Devices for Seismic Protection of Structure, Section 1, p. 1-1, paragaph 1.

* cited by examiner

VARIABLE STIFFNESS BRACING DEVICE

FIELD OF INVENTION

The present invention relates to a variable stiffness bracing device deployed as a smart structural control mechanism of a building, to protect the building against severe vibration and ground motion. The present invention is functioned in retrofitting and rehabilitation of structures where subjected to dynamic loads and vibration due to wind, earthquake and ground movement.

BACKGROUND OF THE INVENTION

Oscillation control of structures under dynamic loads such as earthquake, wind, ground motion and vibration caused by vehicles and machineries movement attract huge interest among structural engineers and researchers. Seismic vibration can cause excessive oscillations of the building which may lead to structural catastrophic failure. Improvement of seismic performance in terms of safety is one of the most concerns in seismic design of structures. Therefore, proper building design and vibration control technologies are implemented to avoid the destructive building failure.

In the last two decades, a lot of research has been done to enhance seismic resistance structural system and control technique to achieve the more economical and safer design (Spencer and Nagarajaiah, 2003). As mentioned above, the traditional seismic design philosophy contains the dissipation of input seismic energy by aid of inherent ductility capacity of structural element through large strains in aforementioned components. In contrary, this approach may lead to structural damage or unrealistic design. For this reason, utilize of energy dissipation devices which is not belonging to the main load resisting system was suggested and designed specifically as external devices for absorption of seismic energy. These devices can be simply substituted after severe excitation (Soong and Dargush, 1997; Symans et al., 2008).

A variety of control schemes have been employed in design practices and generally can be categorized into three types: active control (Yao, 1972), passive control and semi active control (Crosby et al., 1974) Among these methods, passive control systems were developed at the earliest phase, and have been utilized more frequently and practically in seismic design procedure due to the minimum maintenance necessitate and eliminate the external power supply to function. In high seismicity regions, steel moment resisting frames (MRSF) are regularly selected due to adequate energy dissipation capacity, which is granted by large plastic deformation of elements in the moment frames (Bruneau, 1998). This ability permits the structural engineers to design the moment resisting frames under the lowest lateral design force compared with other structural systems. Nevertheless, unanticipated severe events might bring unacceptable great storey displacement. Prior vigorous earthquake events have emphasized the need of seismic retrofitting of present moment frames.

In the recent years, active variable stiffness (AVS), a system for structural control has absorbed numerous attentions and interests. The desire effects and improvement of the structural performance in earthquake excitation of AVS systems were proven by previous studies (Kobori, 1993; Yang et al., 1996). Such a system has been investigated experimentally with implementation in full-scale building in Japan (Kamagata and Kobori, 1994; Kobori and Kamagata, 1992). Most of available variable stiffness system are operated using external electrical controller which may cause delay in system performance. These systems are highly depended on energy recourse and also need repetitive maintenance.

One of the examples of such devices is found in U.S. Pat. No. 6,923,299 where a variable spring member includes a containment housing defining an inner chamber with alternating layers of compressible medium and electro-reactive medium. Adjacent each layer of electro-reactive medium is a coil assembly controlled by a controller. A sealed plate disposed between alternating layers of compressible medium and electro-reactive medium disperses a load exerted on the variable spring member assembly and prevents intermixing of compressible medium with the electro-reactive medium. Actuation of the coil assembly changes physical characteristics and compressibility of the layer of electro-reactive medium to vary spring rate and stiffness.

Therefore it is required to invent a real time system/device which independent of the energy recourse and maintenance procedure.

SUMMARY OF THE INVENTION

According to an aspect of the present invention, the present invention provides a variable stiffness bracing device for structure subjected to dynamic load comprising: a variable stiffness spring attached to a cable to counter the dynamism of the force resulted from the vibration on the structure of a building; characterized in that the variable stiffness bracing system further comprising: a rectangular frame (100) having a solid quarter cylinder (101) at each angle of the rectangular frame (100); a pair of leaf spring (200) attached at each end of the rectangular frame (100) at the solid quarter cylinder (101); a steel rail (300) fixed on top middle of the rectangular frame (100); a core (400) fixed at the tip of each leaf spring (200), the core (400) is slidable along the steel rail (300); a cubic core (500) located in the middle of the core (400); and a rod cable (600) passes through each end of the rectangular frame (100) and the core (400) and ended at the cubic core (500) located in the middle of the core (400).

The above provision is advantageous as the present invention deploys wholly mechanical in retrofitting and rehabilitation of structures. The independence of any other energy such as electrical energy makes the present invention having almost-zero maintenance. The present invention provides less sophisticated mechanism yet effective solution to protect the building against severe ground motion. The effectiveness and the build-up of the present invention are based on the numerical analysis; which explains the rationale or significance of the design or the arrangement of the present invention.

DETAILED DESCRIPTION OF THE PREFERRED EMBODIMENT

Figure 1:
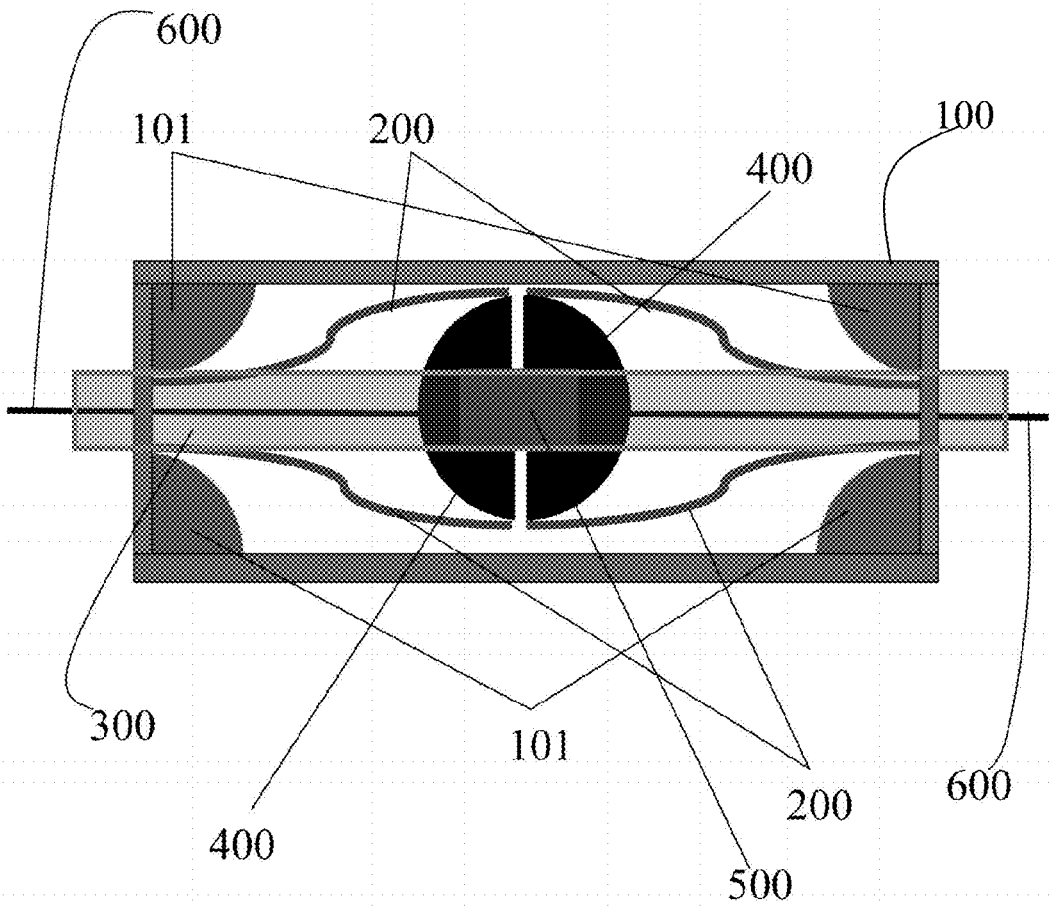
FIG. 1 illustrates an illustration of an embodiment of a variable stiffness bracing device of the present invention.

Generally, the present invention relates to a variable stiffness bracing device for structure subjected to dynamic load comprising: a variable stiffness spring attached to a cable to counter the dynamism of the force resulted from the vibration on the structure of a building; characterized in that the variable stiffness bracing system further comprising: a rectangular frame (100) having a solid quarter cylinder (101) at each angle of the rectangular frame (100); a pair of leaf spring (200) attached at each end of the rectangular frame (100) at the solid quarter cylinder (101); a steel rail (300) fixed on top middle of the rectangular frame (100); a core (400) fixed at the tip of each leaf spring (200), the core (400) is slidable along the steel rail (300); a cubic core (500) located in the middle of the core (400); and a rod cable (600) passes through each end of the rectangular frame (100) and the core (400) and ended at the cubic core (500) located in the middle of the core (400). The entire components of the variable stiffness bracing device are made of hardened steel. The core (400) further comprising a pair of C-shaped solid steel structure.

The steel rail (300) is in rectangular shape. The leaf spring (200) further comprising a non-linear-shaped steel plate screw-fixed at the solid quarter cylinder (101) at one end and at the core (400) at another end. The above provisions are illustrated in FIG. 1.

When the force is applied to the rod cable (600), the cubic core (500) moves and contacts with the core (400), where the leaf springs (200) are clamped. The C-shaped core (400) helps to keep the initial leaf spring (200) shape and change it during the mechanism performs. The four solid quarter cylinders (101) at each angle of the rectangular frame (100) and the C-shaped core (400) are configured as supports to the leaf springs (200), as well as protection from curvature extension. In addition to that, the mechanism of the four solid quarter cylinders (101) at each angle of the rectangular frame (100) and the C-shaped core (400) guarantee that, the leaf springs (200) are not yielded and deformed properly when they reach the maximum curvature.

The present invention increases the lateral stiffness of story without any reduction effect of moment's frame ductility characteristic. It means that the present invention does not operate too much for small or medium vibration's amplitudes but in the case of large one, the present invention controls unacceptably large story drift. The present invention can easily be installed on the lower beam/foundation by aid of horizontal plate of the rectangular frame (100).

Figure 2:
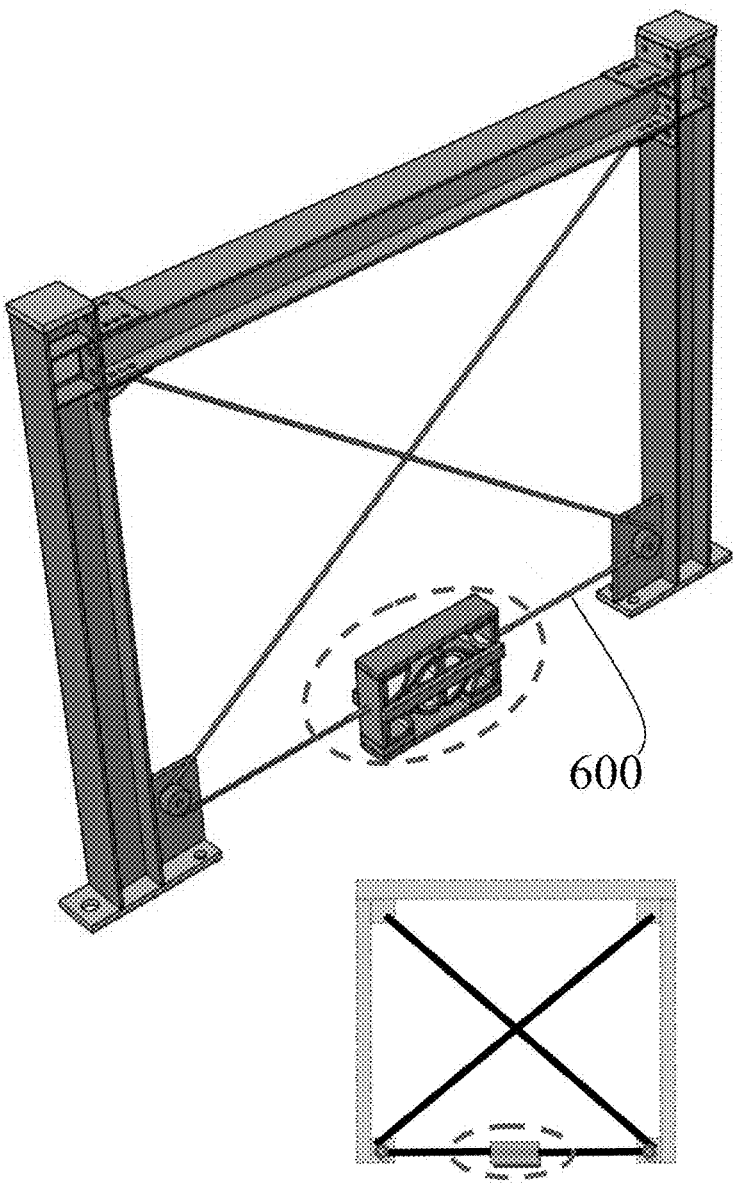
FIG. 2 illustrates the installation of the present invention in steel frame.

FIG. 2 illustrates the installation of the present invention in steel frame. The present invention is attached to the frame by aid of wire cable. Base plate of the rectangular frame (100) of the present invention is fixed by bolts either in lower beam or foundation. The wire rope attaches to the rod cable (600) of the present invention.

Figure 3:
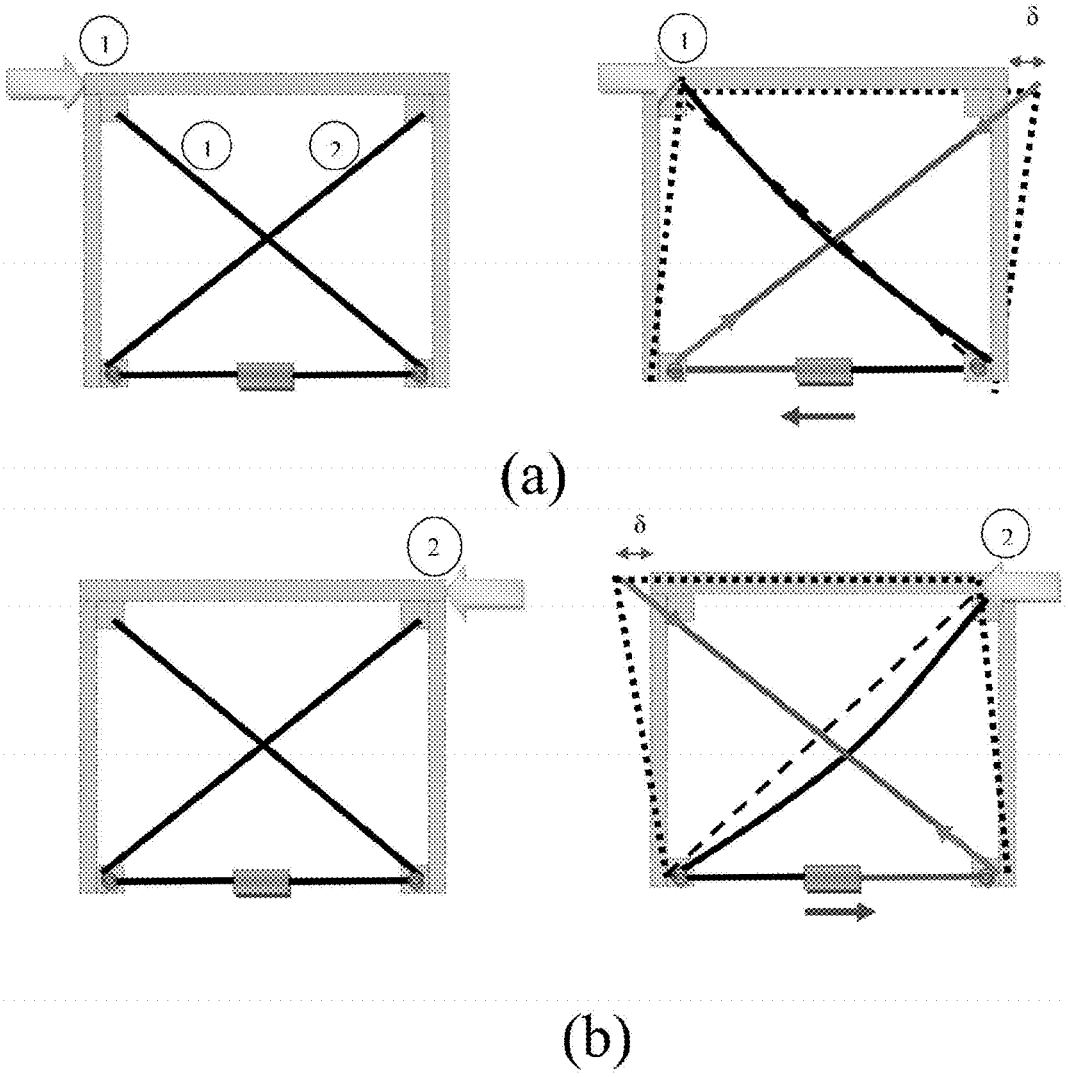
FIG. 3 illustrates the operation of the present invention.

Referring to FIG. 3(*a*), the lateral load is imposed at top of the frame (node 1) from left to right directions. Frame intended to move to the right side; therefore cable 1 operated as the compression member and will be buckled. However, buckling deficiency for compression component is eliminated entirely due to application of cable rope. In contrary, cable 2 performed as a tension member and tensile force is transferred to the present invention. The present invention is desired to move to the left side. At FIG. 3(*b*), the lateral load is applied at node 2 from right to left orientation. So, in following situation cables 1 and 2 are operated as compression and tension elements respectively. In this circumstance, the present invention has a tendency to shift to the right side. The present invention controls the story displacement within the particular limitation.

Although the invention has been described with reference to particular embodiment, it is to be understood that the embodiment is merely illustrative of the principles and applications of the present invention. It is therefore to be understood that numerous modifications may be made to the illustrative embodiment that other arrangements may be devised without departing from the scope of the present invention as defined by the appended claims.

The invention claimed is:

1. A variable stiffness bracing device for a structure subjected to dynamic load comprising:

a variable stiffness spring attached to a rod cable to counter a dynamism of a force resulted from a vibration on a structure of a building;

characterized in that the variable stiffness bracing device further comprising:

a rectangular frame (100) having a solid quarter cylinder (101) at each corner of the rectangular frame (100);

a pair of leaf springs (200) wherein each of said leaf springs is attached at different positions of the rectangular frame (100) at the solid quarter cylinder (101);

a steel rail (300) fixed at the middle of the end of the rectangular frame (100);

a core (400) fixed at a tip of each leaf spring (200), the core (400) is slidable along the steel rail (300);

a cubic core (500) located in the middle of the core (400); and a rod cable (600) passes through each end of the rectangular frame (100) and the core (400) and attached to the cubic core (500).

2. The variable stiffness bracing device as claimed in claim 1, wherein each component of the variable stiffness bracing device is made of a material considered to be hardened steel.

3. The variable stiffness bracing device as claimed in claim 1, wherein the core (400) further comprises a pair of C-shaped solid steel structures.

4. The variable stiffness bracing device as claimed in claim 1, wherein the steel rail (300) is in rectangular shape.

5. The variable stiffness bracing device as claimed in claim 1, wherein the leaf spring (200) is a non-linear-shaped steel plate fixed at one of the solid quarter cylinder (101) at one end and at the core (400) at another end.

* * * * *